US009694293B1

(12) United States Patent
Chiu

(10) Patent No.: US 9,694,293 B1
(45) Date of Patent: Jul. 4, 2017

(54) MULTIPURPOSE GAME APPARATUS

(71) Applicant: Yen-Po Chiu, Taipei (TW)

(72) Inventor: Yen-Po Chiu, Taipei (TW)

( * ) Notice: Subject to any disclaimer, the term of this patent is extended or adjusted under 35 U.S.C. 154(b) by 0 days.

(21) Appl. No.: 15/268,812

(22) Filed: Sep. 19, 2016

(51) Int. Cl.
*A63G 31/00* (2006.01)
*A63H 33/08* (2006.01)

(52) U.S. Cl.
CPC ..... *A63G 31/00* (2013.01)

(58) Field of Classification Search
CPC ..... A63H 3/52; A63H 33/00; A63H 33/04; A63H 33/008; A63H 33/044; A63H 33/08; A63H 33/084; A63H 33/086; A63H 33/062; A63H 33/101; A63H 33/105; A63H 33/107–33/108; A47B 47/0008; A47B 47/0016; E04B 1/34321; E04B 1/2146
USPC ..... 446/108–109, 111–112, 115, 122–123, 446/476, 478; 482/35–37; 24/591.1, 24/592.1
See application file for complete search history.

(56) References Cited

U.S. PATENT DOCUMENTS 1,365,677 A * 1/1921 Flynn, Jr. ..... F16B 45/00 24/598.7
3,827,279 A * 8/1974 Buske ..... B21D 25/04 72/457
3,970,399 A * 7/1976 Palumbo ..... A63H 3/52 403/231
6,631,539 B1 * 10/2003 Chang ..... B60P 7/0807 24/265 H
8,209,916 B2 * 7/2012 Herron ..... E04B 2/12 220/4.28
2002/0193046 A1 * 12/2002 Zebersky ..... A63H 3/52 446/476

* cited by examiner

*Primary Examiner* — Kien Nguyen
(74) *Attorney, Agent, or Firm* — Pro-TECHTOR International Services; Ian Oglesby

(57) ABSTRACT

A multipurpose game apparatus disclosed by the present invention includes at least a foundation, at least a combining slab and at least a shackle. The combining slab is provided with a wavy edge to facilitate installing the combining slab on a wavy slot of the foundation. When two foundations are connected together, two inverted hooks at an end of the shackle are hooked respectively in a snap hole on a left side or a right side of the foundation for positioning. Therefore, by combining the abovementioned elements, a game apparatus in all kinds of combinatorial change in routes can be formed.

4 Claims, 5 Drawing Sheets

MULTIPURPOSE GAME APPARATUS

BACKGROUND OF THE INVENTION a) Field of the Invention

The present invention relates to a multipurpose game apparatus, and more particularly to a game apparatus that is provided with plural styles.

b) Description of the Prior Art

It is known that there are so many kinds and types of game apparatuses on the market and as the conventional game apparatuses are limited to a monotonic design structure, they cannot be combined with one another for use. Therefore, how to choose a game apparatus which can stimulate children to create a fun in exercises and satisfy an autonomous gaming behavior to the children, through the interaction between the learning mode and the game mode, has become a lesson worthy of thinking deeply by the general public and the education industry, which truly requires research, development and innovation.

SUMMARY OF THE INVENTION

The primary object of the present invention is to provide a multipurpose game apparatus that is formed by assembling foundations, combining slabs and shackles, wherein the combining slabs can be combined in formation at top ends or bottom ends of the foundations by locking elements, and two connected foundations can be combined in formation through two inverted hooks of the shackle. Thus, the above-mentioned elements can be assembled into a game apparatus in all kinds of combinatorial change in routes, depending upon the needs of the children.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
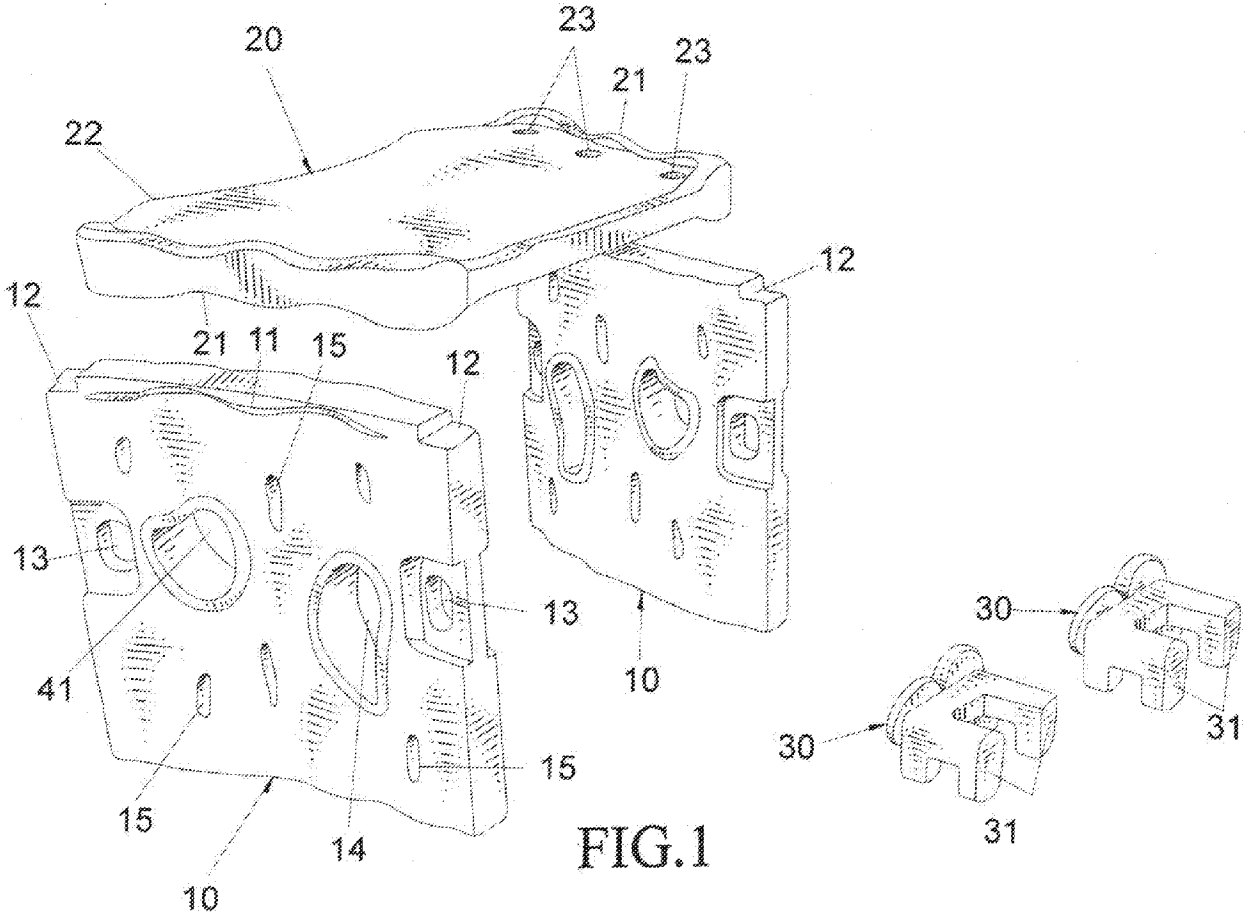
FIG. 1 shows a structural schematic view of the present invention.

Referring to FIG. 1, the present invention discloses a multipurpose game apparatus which comprises at least a foundation 10, at least a combining slab 20, and at least a shackle 30. The foundation 10 is a vertical seat roughly in an arc shape, and a top end of the foundation 10 is provided with a wavy slot 11. Two sides of the wavy slot 11 are provided respectively with a platform 12, and a left side and a right side of the foundation 10 are provided respectively with a snap hole 13. A periphery of the snap hole 13 is a concaved structure, and the foundation 10 is provided with all kinds of perforations 14 and cavities 15.

Figure 2:
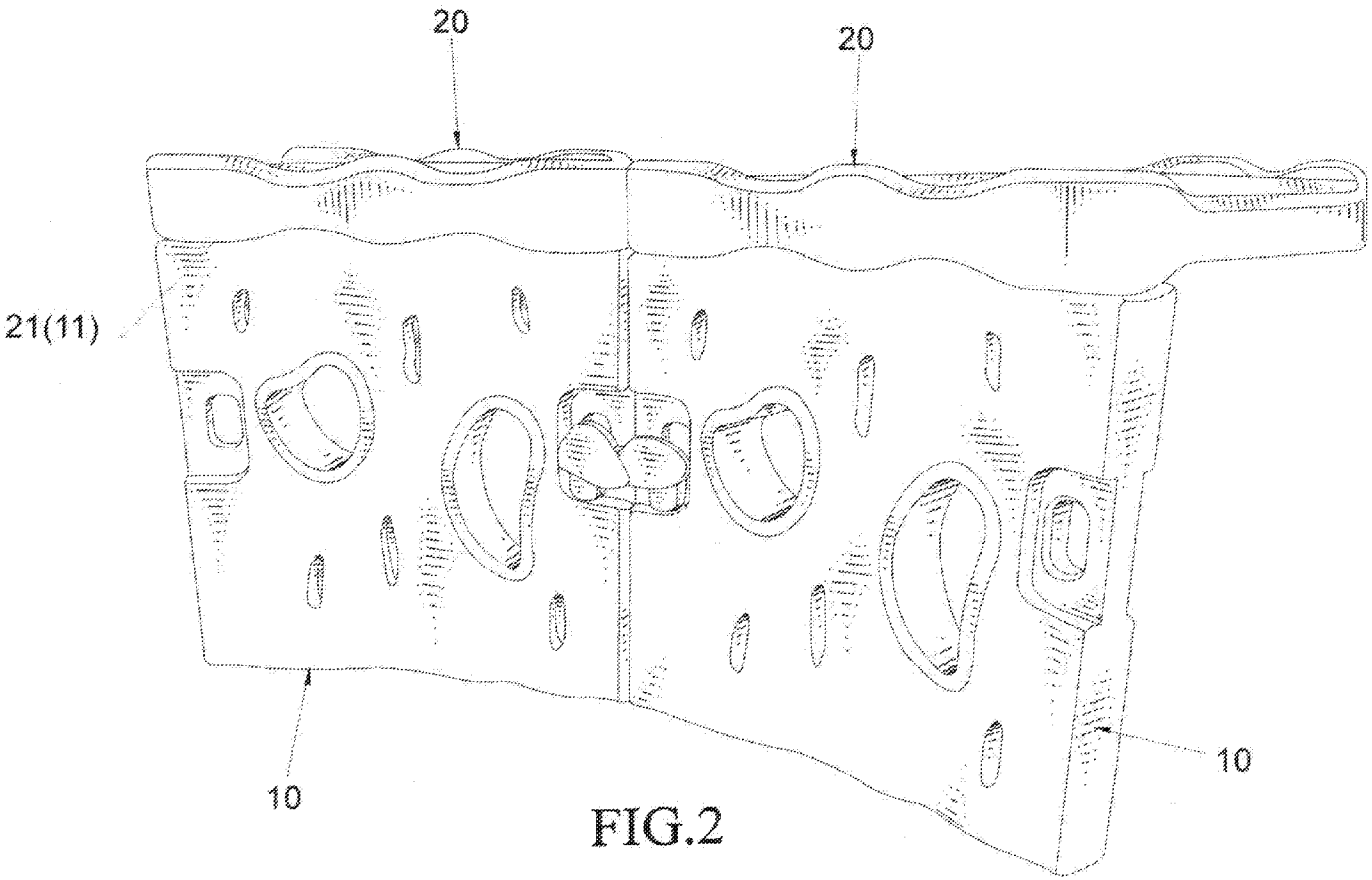
FIG. 2 shows a first kind of structural schematic view of assembly of the present invention.
Figure 3:
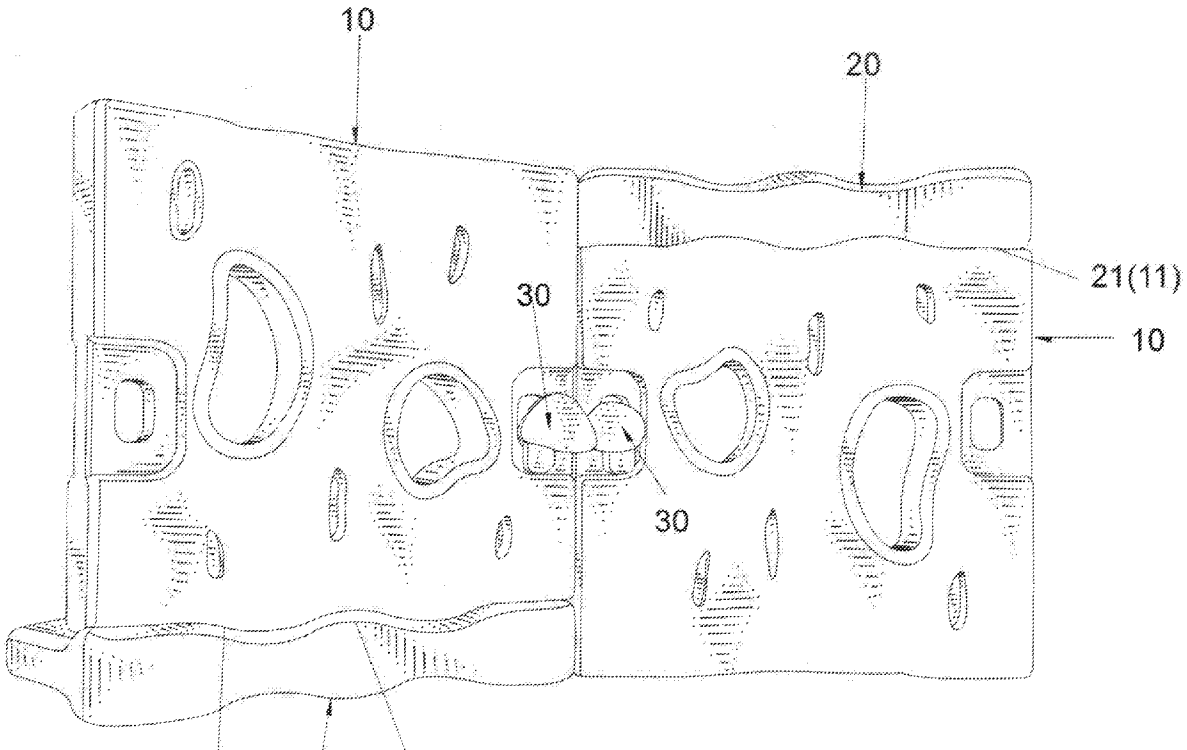
FIG. 3 shows a second kind of structural schematic view of assembly of the present invention.
Figure 4:
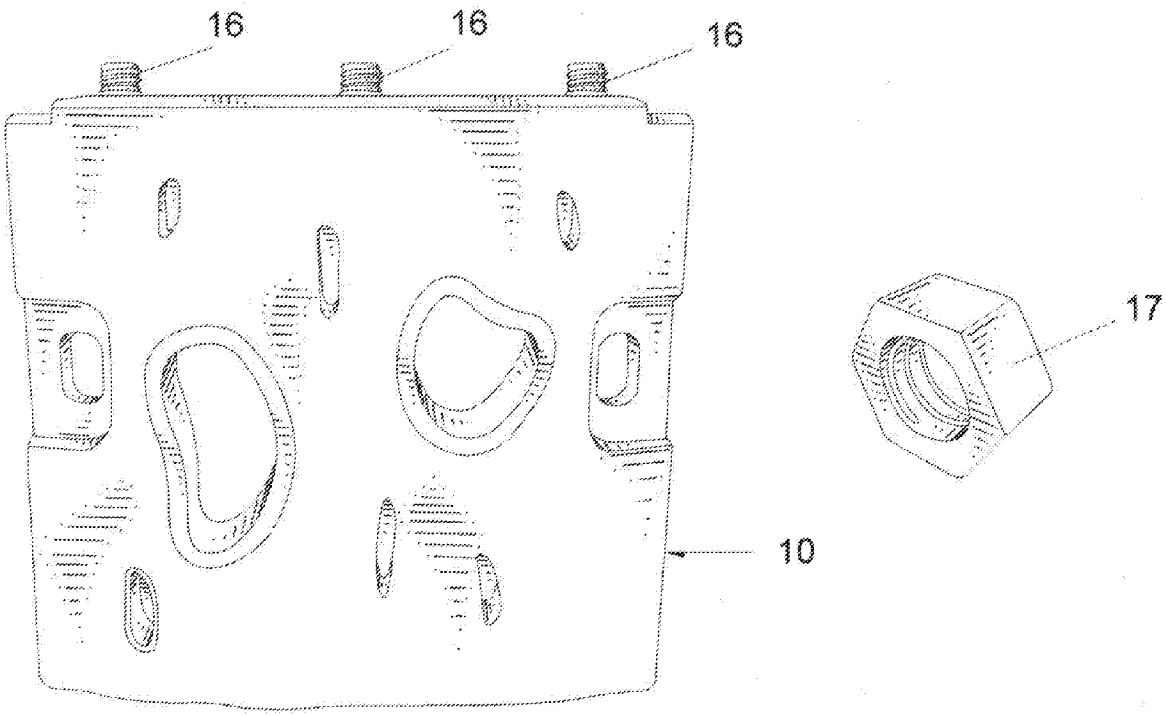
FIG. 4 shows a structural view of a single foundation.

A front end or a rear end of the combining slab 20 is provided with a wavy edge 21 to facilitate installing the combining slab 20 on the wavy slot 11 of the foundation 10 (as shown in FIG. 2). When the other foundation on the left is put upside down, one of the combining slabs 20 is installed on the wavy slot 11 below the upside down foundation 10 (as shown in FIG. 3). An end part of the wavy edge 21 of the combining slab 20 is provided at least with a connecting edge 22 which can be crossed over the platform 12 of the foundation 10. In addition, an inner rim of the wavy edge 21 of the combining slab 20 is provided at least with a lock hole 23. Referring to FIG. 4, a lower end of the foundation 10 is provided at least with a screw 16, and when the combining slab 20 is put on the foundation 10, the screw 16 is transfixed into the lock hole 23 of the combining slab 20 to lock and position the combining slab 20 on the foundation 10 associated with a nut 17.

Figure 5:
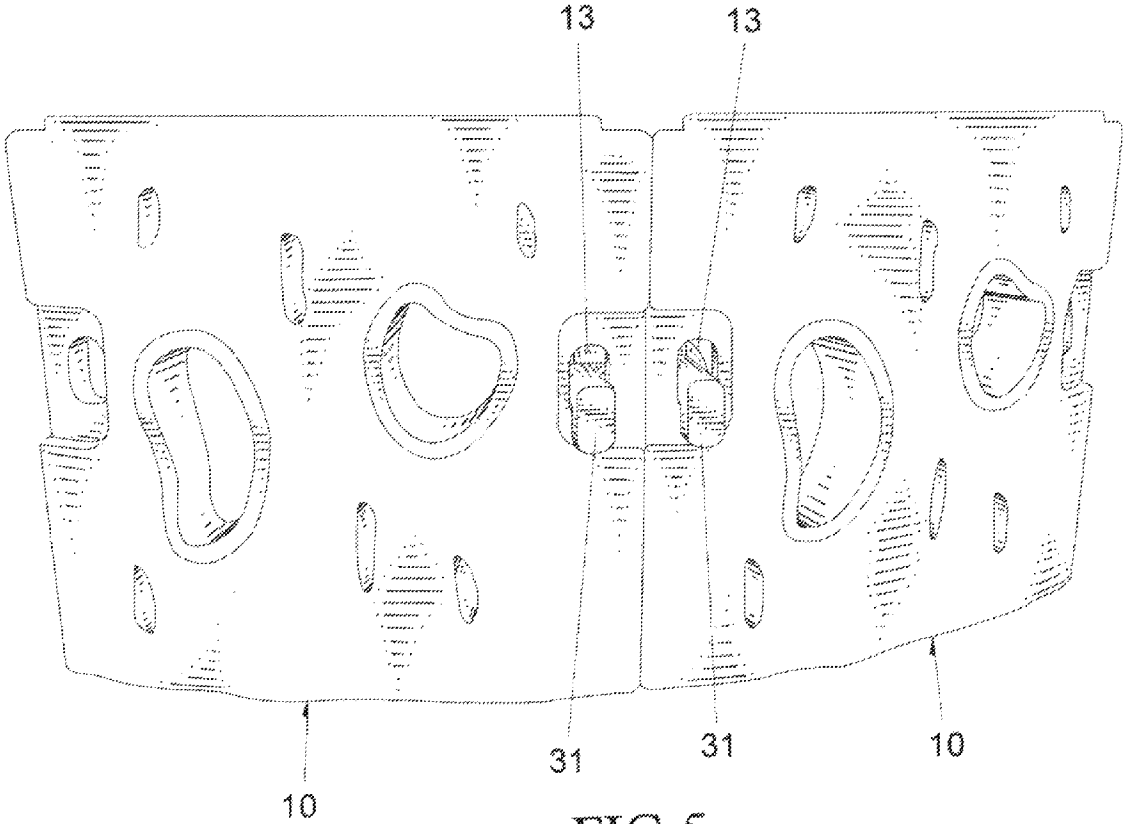
FIG. 5 shows a structural view illustrating that two foundations are latched together.

An end of the shackle 30 is provided with two inverted hooks 31 in an L-shape. Referring to FIG. 3 and FIG. 5, when two foundations 10 are connected together, the two inverted hooks 31 are hooked respectively in the snap hole 13 of the foundation 10 for positioning, with that the inverted hook 31 is put flat in the concaved part at the periphery of the snap hole 13.

By combining the abovementioned parts, all kinds of game apparatus can be formed, and the combinatorial changes in routes are similar to taking an adventure in tree holes.

In light of above, and in accordance with the above description of the embodiments, a game apparatus of the present invention can be very fun and can be played with in many different ways.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A multipurpose game apparatus comprising:

a foundation, with that a top end of the foundation is provided with a wavy slot, and a left side and a right side of the foundation are provided respectively with a snap hole;

a combining slab, with that a front end and a rear end of the combining slab are provided respectively with a wavy edge to facilitate installing the combining slab on the wavy slot of the foundation, and an inner rim of the wavy edge is provided with a lock hole through which a locking element is used to combine the combining slab on the foundation; and a shackle, with that an end of the shackle is provided with two inverted hooks, and when the two foundations are connected together, the two inverted hooks of the shackle are hooked respectively in the snap hole of the foundation for positioning.

2. The multipurpose game apparatus according to claim 1, wherein a lower end of the foundation is provided with a screw, and the screw is transfixed into the lock hole of the combining slab to lock and position the combining slab on the foundation associated with a nut.

3. The multipurpose game apparatus according to claim 1, wherein the foundation is provided with a perforation and a cavity.

4. The multipurpose game apparatus according to claim 1, wherein two sides of the wavy slot of the foundation are provided respectively with a platform, an end part of the wavy edge of the combining slab is provided with a connecting edge, and the connecting edge is crossed over the platform of the foundation.

* * * * *